US005599095A

United States Patent [19]

Elkin

[11] Patent Number: 5,599,095

[45] Date of Patent: Feb. 4, 1997

[54] CONCRETE STRENGTHENING AND ADHESION MATERIAL FEEDING APPARATUS

[76] Inventor: Luther V. Elkin, 1423 Florence Ave., Indiana, Pa. 15701

[21] Appl. No.: 187,629

[22] Filed: Jan. 26, 1994

[51] Int. Cl.[6] ..... B28C 7/04

[52] U.S. Cl. ..... 366/30; 366/154.1

[58] Field of Search ..... 366/1, 64–66, 366/14, 15, 21, 154, 177, 194–196, 271, 292, 297–301, 302, 303, 325, 329, 349, 30, 154.1, 155.1, 155.2

[56] References Cited

U.S. PATENT DOCUMENTS 4,610,545 9/1986 Tomlinson ..... 366/64 X
4,712,919 12/1987 Bouldin ..... 366/177 X

FOREIGN PATENT DOCUMENTS 441844 3/1927 Germany ..... 366/64
2098497 11/1982 United Kingdom ..... 366/64

*Primary Examiner*—Charles E. Cooley
*Attorney, Agent, or Firm*—The Law Offices of Byron A. Bilicki, P.C.

[57] ABSTRACT

An apparatus for the controlled feeding of concrete strengthening and adhesion material, such as plastic fibers, to a concrete mix. The apparatus includes a set of reciprocating spikes that contract the fibers with a comb-like action that separates the individual fibers and moves them forward to a rotating agitator having a central rotating shaft with spokes extending outwardly to provide a further separation of fibers and a forward movement of the fibers toward a rotating impeller which moves the fibers forward and downward to a duct which exits to a concrete mixing apparatus. The separation of the fibers prior to entry into the concrete mix serves to inhibit or prevent subsequent aggregation or balling of the fibers in the mix.

1 Claim, 10 Drawing Sheets

CONCRETE STRENGTHENING AND ADHESION MATERIAL FEEDING APPARATUS

BACKGROUND OF THE INVENTION

1. Field of the Invention

The present invention relates to concrete mixers and in particular to concrete strengthening and adhesion material feeder apparatus for producing a mix for fibrous concrete i.e. concrete strengthened and improved adhesion by the addition of concrete strengthening and adhesion material.

2. Description of the Prior Art

Certain problems arise during the production of such a fibrous concrete mix as the fibres have to be evenly distributed throughout the mix in order for the maximum benefits to the concrete to be achieved. In particular the feed of the fibers into the mix has to be such that the fibers are not formed into "balls" rather than being evenly distributed throughout the mix.

It is therefore the general object of this invention to provide a concrete strengthening and adhesion material feeding machine which overcomes the above problems and which produces a mix, to add in any desired proportions, of cement, aggregate and fibers.

A concrete strengthening and adhesion material feeding machine in accordance with the invention comprises a feed for concrete strengthening and adhesion material and aggregate incorporating a hopper for material, a means to separate and process said material, a metering means and a discharge outlet.

The use of a concrete strengthening and adhesion material hopper of this nature ensures that the material are fed evenly to the processing means and the danger of fibres of metal or other types of material being attracted together by self-magnetism or self-sticking and being formed into balls is substantially reduced.

Conveniently the hopper is reciprocated over an material combing and separating means.

The equipment is suitable for any form of concrete strengthening and adhesion material and the flow of material can be changed so that the size and shape of the material is appropriate to the particular type of material and to the feed desired. Equally, the feed of concrete strengthening and adhesion material may be varied by varying the depth or frequency of reciprocation of the compressor in the hopper, by varying the level of concrete strengthening and adhesion material maintained in the hopper during operation, or by varying the size of the outlet from the hopper.

Preferably concrete strengthening and adhesion material is fed to the hopper through a delivery opening and the opening and the compressing means may be vibrated to assist even flow of material. If the delivery opening is disposed over the mouth of the hopper then the level of concrete strengthening and adhesion material contained therein can be maintained substantially constant as the hopper reciprocates beneath the feed end of the processing means.

The concrete strengthening and adhesion material feeding apparatus may be mounted on wheels or on slides for reciprocal movement across its outlet port.

The concrete strengthening and adhesion material may be made of metal, plastics, glass or any other convenient material and may be made of any desired shape or configuration to suit the desired ultimate concrete mix.

The flow of concrete strengthening material may be varied by varying the speed of rotation of the impeller-agitator combination by adjusting the size of the adjustable metering gate.

The apparatus may also include a blowing unit into which works in conjunction to the feeding apparatus comprises a venting hopper connected to a source of pressurized air. The mix on entering the hopper is manipulated so that an even flow of material may be discharged from the hopper by the air pressure through an outlet port. This device helps to ensure an even supply of mix to the concrete through the outlet port and thus prevents surging.

Recent years have seen an upsurge in the use of fiber reinforced concrete. Structures formed of fiber reinforced concrete have superior strength over unreinforced concrete and, in many instances, can be employed in lieu of concrete reinforced with reinforcing rods or bars (rebars) to provide similar strength at lesser cost.

Various fibers have been employed. Most often, steel fibers are used, but in many instances, ceramic fibers, such as glass fibers, have been employed. Typically, the fibers are dispersed randomly within the mix and the structures resulting from a pour of the mix. As a consequence, the maximum reinforcement provided by a given number of fibers cannot be achieved. Those fibers parallel to the direction of a bending force application to the concrete structure provide no reinforcing whatsoever, while those fibers only slightly angled with respect to the direction of the bending force application provide but minimal reinforcement. Consequently, it has been necessary to incorporate in such concrete, a far greater number of fibers than actually necessary to ensure that proper reinforcing will be achieved with such a random distribution.

This, in turn, has posed not only an economical problem due to the cost of the increased amount of fibers, but a labor problem as well. When used in the large amounts required, the fibers have a tendency to adhere to each other or "ball." When balls are left in the poured concrete, a weak spot is formed. Moreover, the presence of such balls impedes finishing operations. Accordingly, it has been necessary to manually retrieve the fiber balls from the concrete as it is being poured and finished.

Fine aggregates comprising river or mountain sand or artificial particles are widely used to prepare cement mortar or line stone type hydraulic mortar which is used to construct buildings or many other civil structures.

Although the composition and particle size of the sand also influences the quality of the product, so long as sand collected from the same source is used it is easy to utilize the sand having the same composition and particle size and it is rare to admit sands from different sources. When the sand contains particles of different size it is easy to classify them into fine, medium and coarse particles with a sieve and a small difference in the particle size does not result in a great difference in the quality of the product.

Numerous innovations for concrete strengthening and adhesion material feeding apparatus have been provided in the prior art that are adapted to be used. Even though these innovations may be suitable for the specific individual purposes to which they address, they would not be suitable for the purposes of the present invention as heretofore described.

SUMMARY OF THE INVENTION

It is the principal object of the invention to provide a new and improved concrete strengthening and adhesion material feeding apparatus. More specifically it is an object to provide a method of forming a concrete strengthening and adhesion material concrete mix and an apparatus for performing the method.

The inventive method achieving the foregoing objects, in its broadest sense, includes the step of forming a composite of concrete strengthening and adhesion material, distributing reinforcing material on or throughout the concrete mix, and applying a further addition of concrete to the first mixture and the concrete strengthening and adhesion material distributed thereon before the first mixture has set. As a consequence, the concrete strengthening and adhesion material will have a substantially two-dimensional orientation so as to all be substantially transverse to the direction of force application to the resulting concrete mix. Consequently, all concrete strengthening and adhesion material are load bearing with the result that the number of concrete strengthening and adhesion material employed may be minimized over prior art methods.

According to a preferred embodiment of the invention, the foregoing steps are repeated until a desired thickness of the resulting concrete structure is approached. A final covering mix of concrete is then applied.

The amount of concrete strengthening and adhesion material deposited on each mix may be varied in accordance with expected stress characteristics. In some cases, the number of concrete strengthening and adhesion material deposited on each mix will be increased as the method is performed, while in other cases, the opposite will be true. In most cases, during the fabrication of the structure, the number of concrete strengthening and adhesion material deposed on each mix will be progressively decreased until approximately half of the desired thickness of the structure is attained, at which time a progressive increase of the number of concrete strengthening and adhesion material deposited on each sheet may be initiated.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

LIST OF REFERENCE NUMERALS UTILIZED IN THE DRAWING

Figure 1:
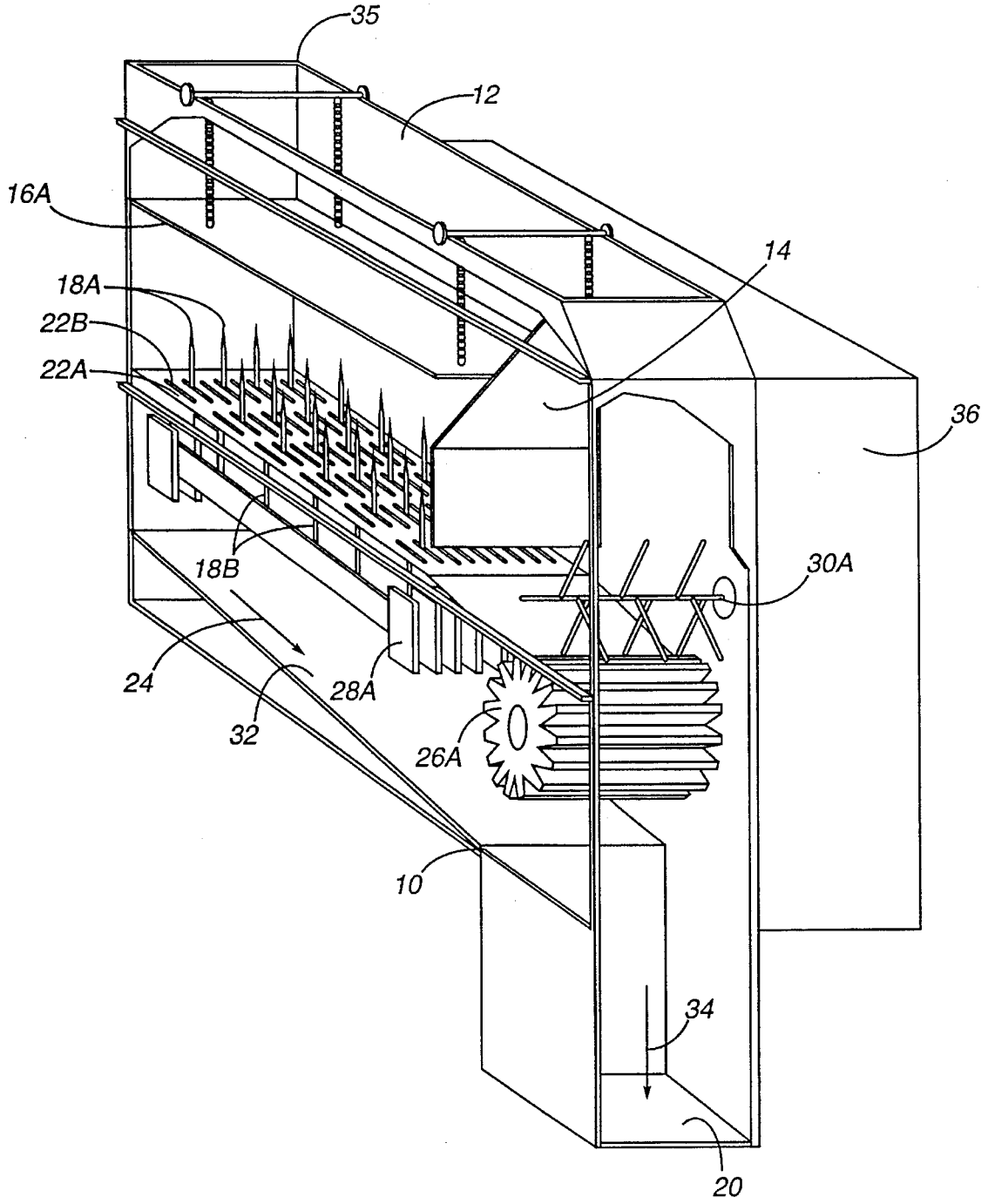
FIG. 1 is a perspective view of a concrete strengthening and adhesion material feeding apparatus exhibiting material processing means and first housing as well as material processing mechanical driving means second housing.

10—A CONCRETE STRENGTHENING AND ADHESION MATERIAL FEEDING APPARATUS
12—MATERIAL INGRESS
14—ADJUSTABLE METERING GATE
16A—MATERIAL COMPRESSOR
16B—MATERIAL COMPRESSOR CHAIN
16C—MATERIAL COMPRESSOR CROSSMEMBER END CAPS
16D—MATERIAL COMPRESSOR CROSSMEMBER
18A—EXTENDED SPIKES
18B—RETRACTED SPIKES
20—PROCESSED MATERIAL EXIT DUCT
22A—SLOTTED SPIKE GUIDE PLATE
22B—SPIKE GUIDE
24—DIRECTION OF MATERIAL FEEDING
26A—IMPELLER
26B—IMPELLER MAIN BODY
26C—IMPELLER LONGITUDINAL OPENING
26D—IMPELLER SHAFT
26E—IMPELLER MALE KEYWAY
26F—IMPELLER FEMALE KEYWAY
28A—FEEDER CAM
28B—FEEDER CAM REAR CAM PLATE
28C—FEEDER CAM CROSS MEMBER
28D—FEEDER CAM REAR SHAFT
28E—FEEDER CAM FRONT SHAFT
28J—FEEDER CAM REAR SHAFT SLOT
28K—FEEDER CAM FRONT SHAFT SLOT
28L—FEEDER CAM MIDDLE CAM PLATE
28M—FEEDER CAM FRONT CAM PLATE
30A—AGITATOR

30B—AGITATOR SHAFT
30C—AGITATOR CABLE TIES
30D—AGITATOR HALF WASHERS
32—ANGLED BOTTOM PLATE
34—DIRECTION OF MATERIAL FEEDING INTO CONCRETE
35—MATERIAL FEEDING HOUSING
36—HOUSING FOR MOTOR, GEARS AND CHAINS
38—CONCRETE STRENGTHENING AND ADHESION MATERIAL
40—CONCRETE MIX
42A—SPIKE BAR
42B—SPIKE
42C—SPIKE BAR END CAP
42D—SPIKE BAR CROSS MEMBER
44A—MATERIAL FEEDER ENCLOSURE
44B—MATERIAL FEEDER ENCLOSURE TOP COVER
44C—MATERIAL FEEDER ENCLOSURE TOP COVER HANDLE
44D—MATERIAL FEEDER ENCLOSURE TOP COVER FASTENER
44E—MATERIAL FEEDER ENCLOSURE TOP FRONT SIDE DOOR
44F—MATERIAL FEEDER ENCLOSURE FRONT DOOR HINGE
44G—MATERIAL FEEDER ENCLOSURE LOWER FRONT SIDE DOOR
44H—MATERIAL FEEDER ENCLOSURE LOWER FRONT SIDE DOOR HANDLE
44I—MATERIAL FEEDER ENCLOSURE MATERIAL DUCT
44J—MATERIAL FEEDER ENCLOSURE LOWER SIDE FRONT BRACKET
44K—MATERIAL FEEDER ENCLOSURE LOWER SIDE BOTTOM MIDDLE BRACKET
44L—MATERIAL FEEDER ENCLOSURE LOWER SIDE TOP MIDDLE BRACKET
44M—MATERIAL FEEDER ENCLOSURE LOWER SIDE REAR BRACKET
44N—MATERIAL FEEDER ENCLOSURE LOWER SIDE REAR BRACKET OPENING
440—MATERIAL FEEDER ENCLOSURE LOWER SIDE FRONT OPENING
44P—MATERIAL FEEDER ENCLOSURE LOWER SIDE MIDDLE BRACKET
44Q—MATERIAL FEEDER ENCLOSURE UPPER SIDE MIDDLE BRACKET
44R—MATERIAL FEEDER ENCLOSURE UPPER SIDE MIDDLE BRACKET SUPPORT MEMBER
44S—MATERIAL FEEDER ENCLOSURE UPPER SIDE FRONT BRACKET
44T—MATERIAL FEEDER ENCLOSURE UPPER SIDE FRONT BRACKET OPENING
44U—MATERIAL FEEDER ENCLOSURE UPPER SIDE REAR BRACKET
44V—MATERIAL FEEDER ENCLOSURE LIMIT SWITCH STOP
44W—MATERIAL FEEDER ENCLOSURE BOTTOM PAN
44X—MATERIAL FEEDER ENCLOSURE BOTTOM
44Y—MATERIAL FEEDER RIGHT AND LEFT HAND PANEL
44Z—MATERIAL FEEDER DRIVE - SIDE BEARING PLATE
45A—MATERIAL FEEDER TOP HOUSING PANEL
46A—MOTOR
46B—MOTOR SHAFT
46C—MOTOR SHAFT PULLEY
48—LINE SHAFT
50—MOTOR SHAFT
51—DRIVE SHAFT 1
52—IMPELLER SHAFT
53—AGITATOR SHAFT
54—DRIVE SHAFT 2
55—DRIVE SHAFT 3
56—LINE SHAFT INNER PULLEY
58—LINE SHAFT OUTER PULLEY
60—LINE SHAFT BELT
62—LINE SHAFT IDLER
64—MOTOR SHAFT OUTER PULLEY
66—MOTOR SHAFT INNER PULLEY
68—MOTOR SHAFT IDLER
70—DRIVE SHAFT 1 OUTER PULLEY
72—DRIVE SHAFT 1 INNER PULLEY
74—DRIVE SHAFT 1 IDLER
76—DRIVE SHAFT 2 INNER PULLEY
78—DRIVE SHAFT 3 IDLER
80—DRIVE SHAFT 2 OUTER PULLEY
82—DRIVE SHAFT 3 PULLEY
84—AGITATOR SHAFT PULLEY
86—AGITATOR IDLER
88—IMPELLER SHAFT PULLEY
90—AGITATOR BELT
92—MOTOR SHAFT BELT
94—DRIVE SHAFT 1 BELT
96—DRIVE SHAFT 3 BELT
98—LINE SHAFT BEARING
100—LINE SHAFT BRACKET

DETAILED DESCRIPTION OF THE PREFERRED EMBODIMENT

Figure 2:
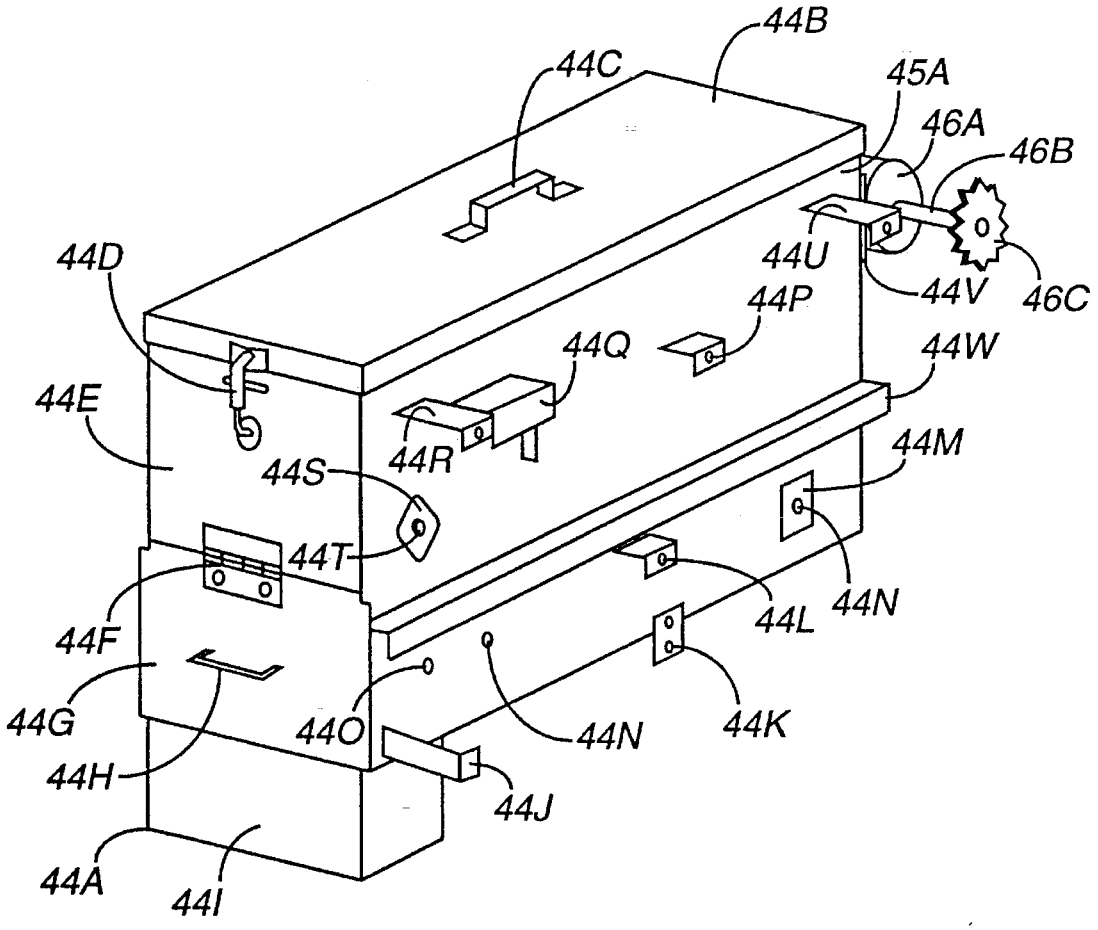
FIG. 2 is a perspective view of a second housing which encases material processing mechanical driving means.
Figure 3:
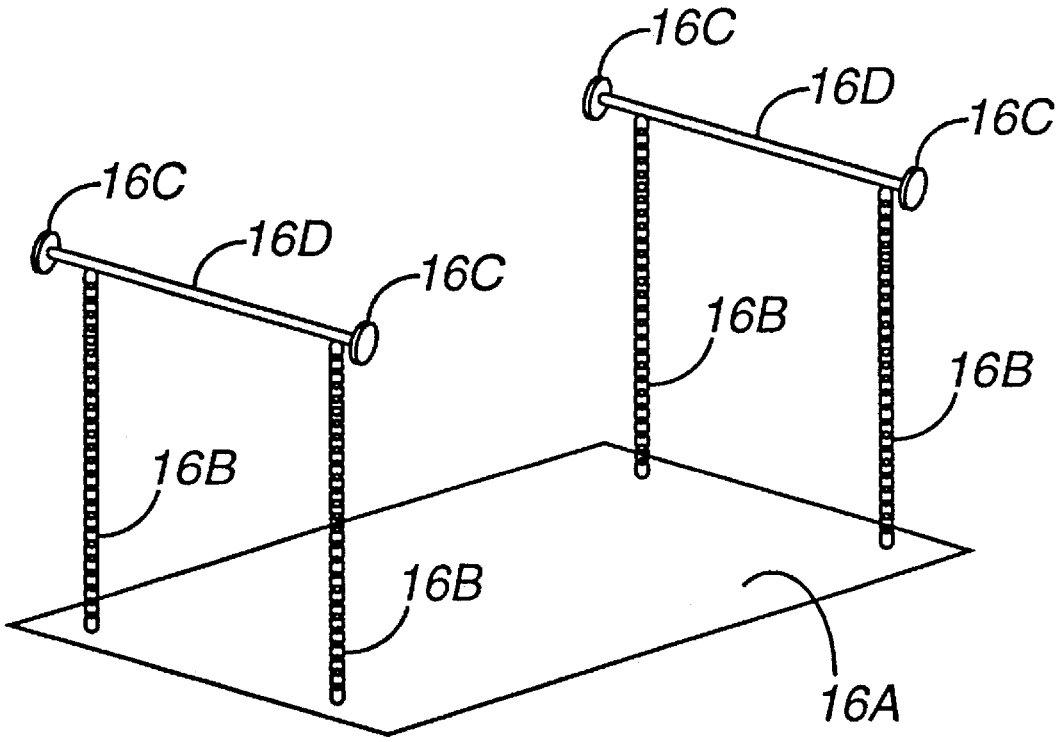
FIG. 3 is a perspective view of a material compressor means exhibiting a material compressor chains, cross members, and cross member end caps.

With reference to FIG. 1, a concrete strengthening material feeding apparatus, constructed in accordance with a preferred embodiment of the invention, includes a housing 35, having a n entrance 12 for the introduction of concrete strengthening and adhesion material (hereinafter referred to as "fibrous material") and a material compressor 16A. As detailed in FIG. 3, a weighted plate that is removably suspended by a plurality of chains 16B and crossmembers 16D having endcaps 16C. In practice, the material compressor is removed while fibrous material is loaded into the apparatus through entrance 12. The material compressor 16A may then be replaced to provide a compressive force on the fibrous material. The fibrous material comes to rest on reciprocating spikes 18A and 18B and spike guide plate 22A and is pushed downward thereto by the weight of material compressor 16A. The reciprocating spikes, shown in extended position 18A and retracted position 18B, move in a reciprocating motion to disperse and separate the fibrous material in a comb-like fashion and move it in a path, shown by arrow 24, toward rotating agitator 30A and impeller 26A. The reciprocating spikes 18A and 18B protrude through a slotted spike plate 22A by virtue of spike guide 22B. The spikes 18A and 18B are mounted on spike bars 42A and rotate in response to the rotation of a plurality of camshafts 28A. A vertically adjustable metering gate 14 functions to regulate the amount of material moving toward agitator 30A and impeller 26A. Angled bottom plate 32 slopes downward toward processed material exit duct 20. This bottom plate serves to catch stray bits of fibrous material that may fall through the spike guide plate 22A and directs them toward the concrete mix. FIG. 2 shows a material enclosure 44A, material top cover 44B, containing a fastener 44D, the top cover 44B which opens manually by a handle 44C to allow addition of the material, a top front side door 44E which is openably attached by a hinge 44F, a lower front side door 44G openable with a handle 44H, a material feeder enclosure duct 44I which introduces the material to the concrete mix, a material feeder enclosure lower side bracket which attaches said housing 35 to a second housing 36 which encases a mechanical powering means, a lower side bottom middle bracket 44K, a lower side top middle bracket 44L, lower side rear bracket 44M, lower side rear bracket opening 44N which corresponds to a front cam feeder shaft lower side front bracket opening 440 which corresponds to an impeller shaft, a lower side middle bracket 44P, upper side middle bracket 44Q, a upper side middle bracket support member 44R, upper side front bracket 44S, upper side front bracket opening 44T which corresponds to an agitator shaft, a upper side rear bracket 44U, a material feeder enclosure limit switch stop 44V, a bottom pan 44W, an enclosure bottom 44X, a right and left had panel 44Y which are securely fastened to the front panel 44E and a top housing panel 45A, and material feeder drive side bearing plate 44Z to which a motor 46A is mounted. Said motor 46A consists of a motor shaft 46B upon which a motor shaft pulley 46C is mounted.

Figure 16:
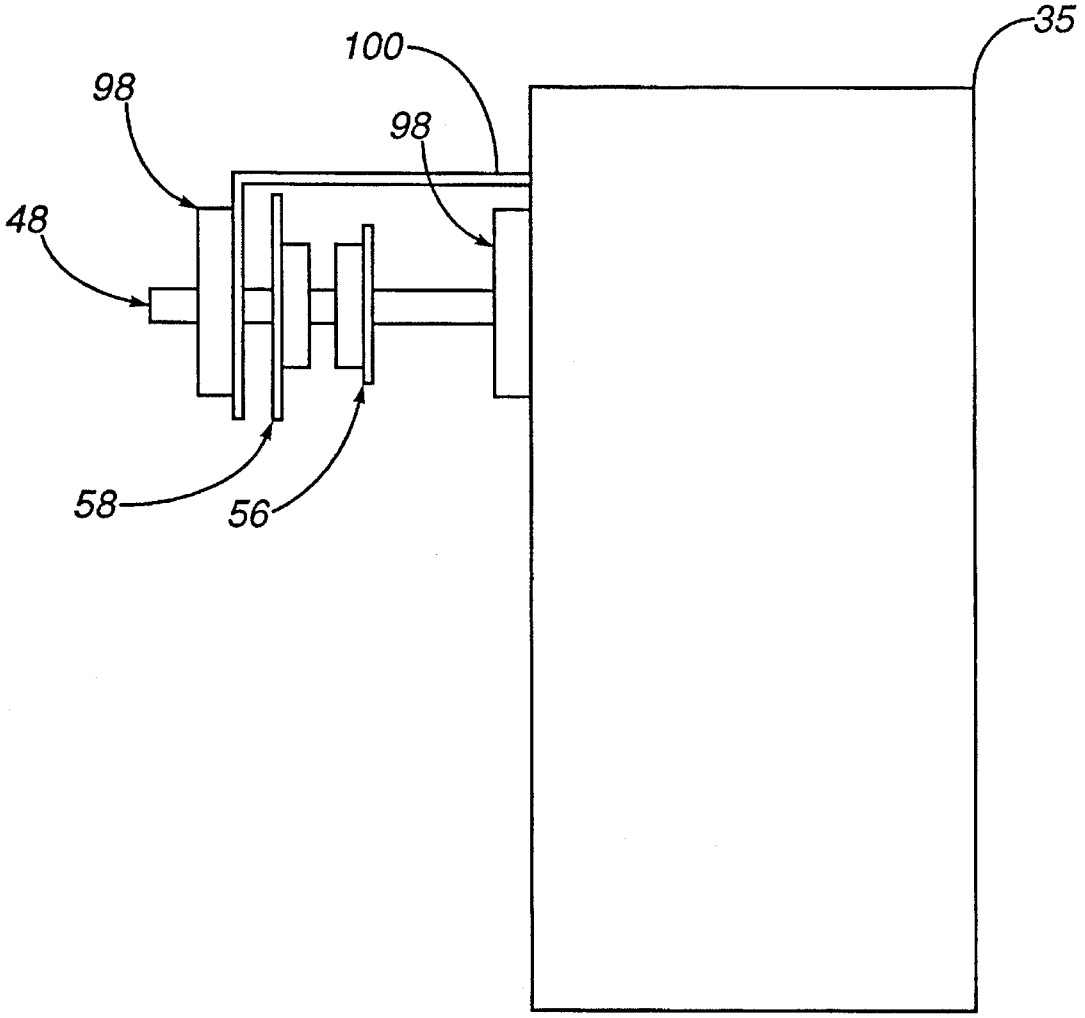
FIG. 16 is a front view of a material feeding housing exhibiting a line shaft having bearings and pulleys contained therein.

Referring to FIG. 16; a line shaft bracket 100 is mounted on the material feeding housing 35. The line shaft bracket 48 secures in a movable configuration, a line shaft 48 upon which is mounted at bearings 98, a line shaft outer pulley 58 and a line shaft inner pulley 56.

Figure 4:
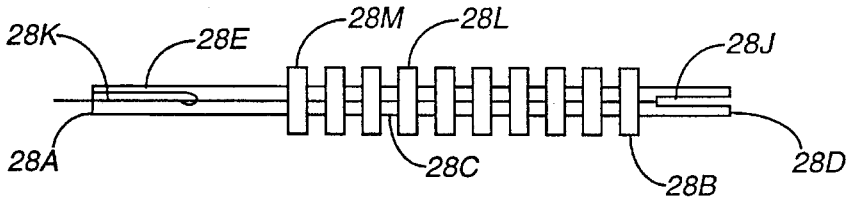
FIG. 4 is a top view of a feeder cam exhibiting rear shaft and front shaft slots formed therein.
Figure 5:
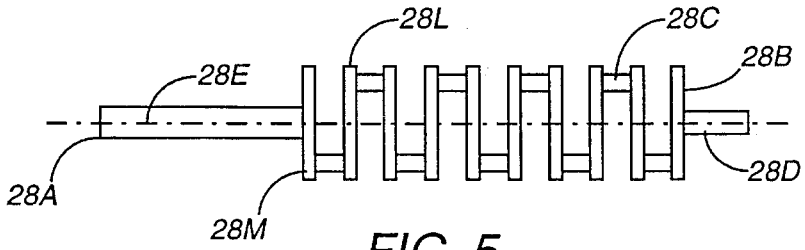
FIG. 5 is a side view of a feeder cam exhibiting cam cross members in alternating opposite positions to one another.

Referring to FIGS. 4 and 5; the feeder cam 28A contains a sequence of components such as a front shaft 28E which is movably attached to a bar containing spikes 42D, a front cam plate 28M, a plurality of middle cam plates 28L, a plurality of cross members 28C which are arranged in unparrallel configuration to one another, thus, allowing spikes 18A and 18B to extend and retract, respectively upon rotation of the shaft 28E, the front shaft 28E has a slot 28K contained therein which securely but movably attaches the spike bar 42D, a feeder cam rear plate 28B which is securely attached to a feeder cam rear shaft 28D having a slot 28J which securely mounts pulleys 54 and 55.

Figure 6:
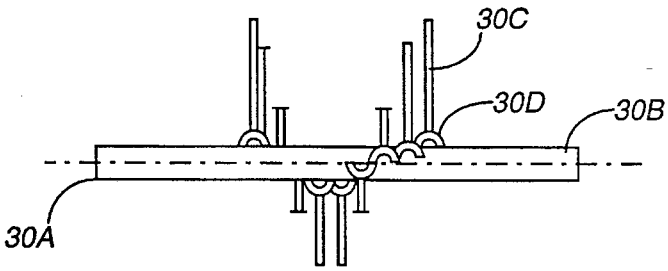
FIG. 6 is a side view of an agitator exhibiting spiral finger-like projections which are individually secured to an agitator half washer that is securely fastened to a agitator shaft.
Figure 8:
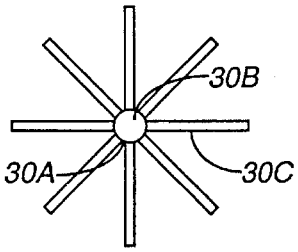
FIG. 8 is a cross sectional view of an agitator exhibiting omni-directional finger-like projections extending outwardly from a central shaft.
Figure 7:
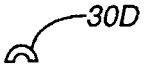
FIG. 7 is a cross-sectional view of a agitator half washer.

The agitator 30A, shown in FIG. 1 and further detailed in FIGS. 6, 7, and 8, comprises a rotatable agitator shaft 30B having loosely connected thereto a plurality of spoke-like cable ties 30C held loosely, but securely, in place by half washers 30D. As the agitator is rotated, the cable ties act to separate and disperse the fibers and push the fibrous material toward the impeller and exit duct 20.

Figure 9:
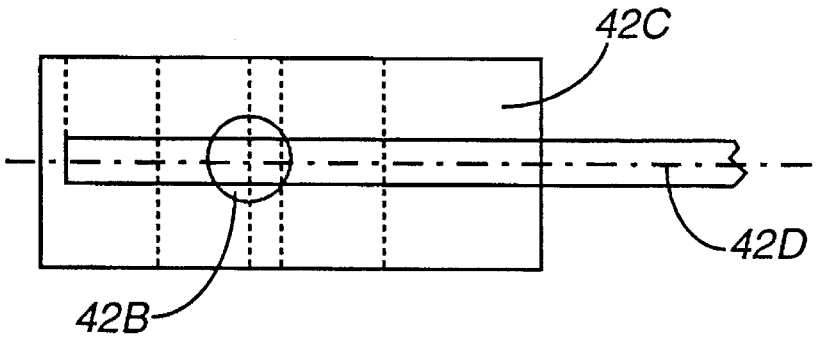
FIG. 9 is a top view of a distal end of a bar containing spikes and an end cap.
Figure 10:
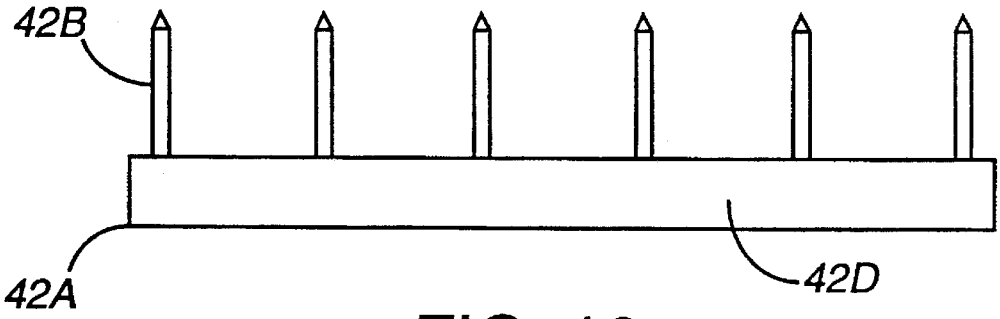
FIG. 10 is a side view of a bar exhibiting spikes extending outwardly on a top edge.
Figure 11:
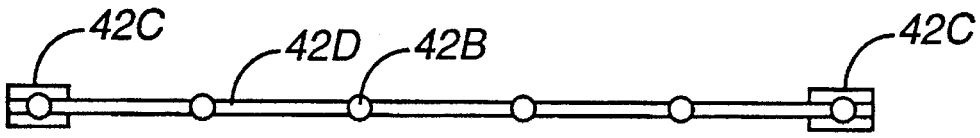
FIG. 11 is a top view of a bar exhibiting spikes distributed throughout and terminal distal end caps.
Figure 12:
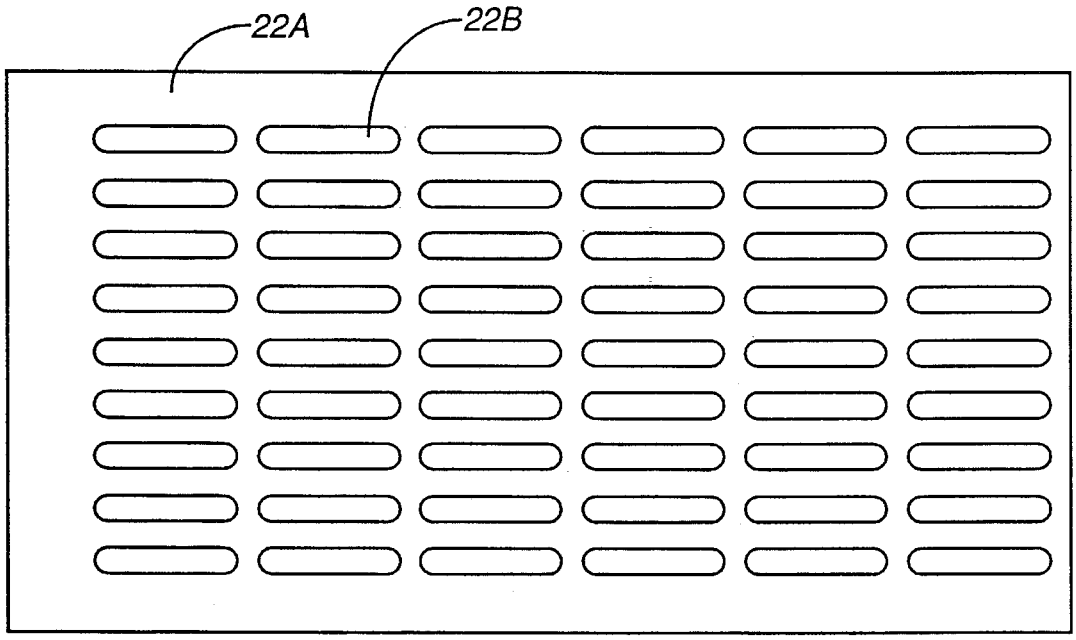
FIG. 12 is a top view of a slotted spike guide plate exhibiting a plurality of spike guides.

Referring to FIGS. 9, 10 and 11; the spike bar 42A contains multiple spikes 42B and end caps 42C located at opposite distal ends of the spike bar 42A. The end caps 42C in conjunction with the spike bar 42B movably attached said component to shafts 54 and 55 which rotate in unison to extend said spikes 42 in an extended 18A and retracted 18B fashion.

Figure 13:
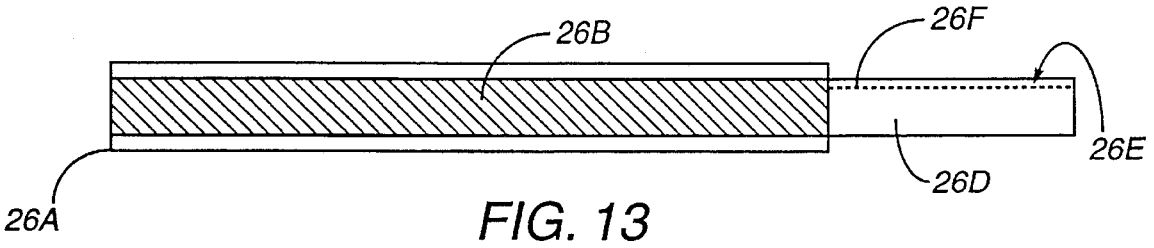
FIG. 13 is a side view of an impeller shaft exhibiting a female key slot on an impeller shaft.
Figure 14:
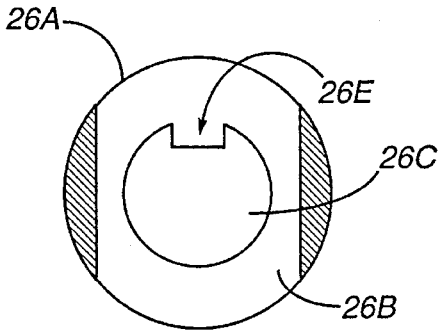
FIG. 14 is a cross sectional view of an impeller exhibiting a male key slot.

Referring to FIGS. 13 and 14; the impeller 26A contains a cylindrical main body 26B having a longitudinal opening 26C which allows mounting said unit on a rotatable impeller shaft 26D. The main body 26B and the shaft 26D are securely attached by male 26E and female 26F keyways, respectively.

Figure 15:
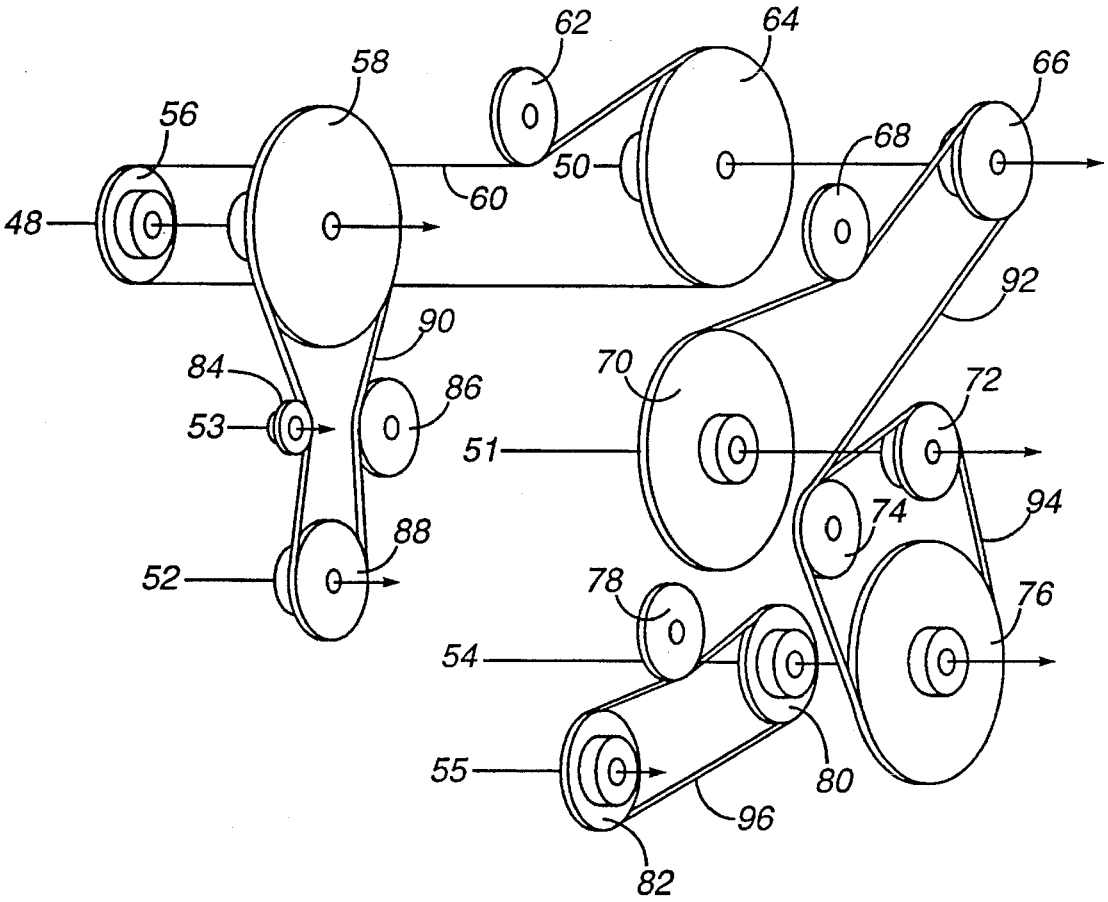
FIG. 15 is a perspective view of one inter-relational configuration of shafts, pulleys, idlers and belts which constitute the material processing mechanical powering means.

Referring to FIG. 15; an inter-relational configuration comprising in direct relationship as described herein or in combination thereof; an inner pulley 66 firmly affixed to a motor shaft 50 of said powering motor 46A which is directly connected to a drive shaft 1, 51 by a belt 92 and drive shaft outer pulley 70, said belt 92 has an idler 68 interspersed functioning to engage or disengage both pulleys; said drive shaft 1, 51, is also directly connected to a second inner pulley 72 mounted thereon, said second shaft 1 inner pulley 72 is connected to another inner pulley 76 directly mounted on drive shaft 2, 54, thereon, both drive shaft inner pulley 1, 72 and drive shaft 2 inner pulley 76 are connected by a belt 94 with an idler 74 interspersed functioning to engage or disengage both pulleys; said drive shaft 2, 54, is also directly connected to a second outer pulley 80 mounted thereon, said second shaft outer pulley 80 is connected to another pulley 82 directly mounted on drive shaft 3, 55, and drive shaft pulley 2 and drive shaft 3 pulley 82 are connected by a belt 96 with an idler 78 interspersed functioning to engage or disengage both pulleys; said motor shaft 50 also has a second outer pulley 64 directly mounted thereon, said second motor pulley 64 is connected to a line shaft inner pulley 56 which is directly mounted on a line shaft 48, said line shaft inner pulley 56 and said second motor outer pulley 64 are connected by a belt 60 with an idler 62 interspersed functioning to engage or disengage both pulleys; and said line shaft 48 has a second outer pulley 58 directly mounted thereon which is connected by a belt 90 to at least two additional pulleys, 84 and 88, at least one which is directly mounted on said agitator shaft 53 and at least one other which is directly mounted on at least one said impeller shaft 52, said line, agitator and impeller shaft pulley connecting belt 90 has an idler 86 interspersed functioning to engage or disengage said pulleys.

Figure 17:
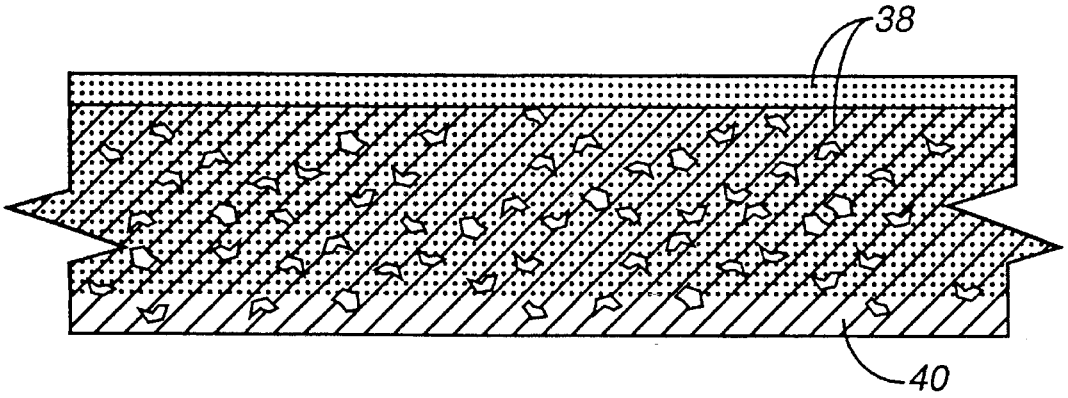
FIG. 17 is a cross sectional view of concrete mix with concrete strengthening and adhesion material distributed throughout and extending outwardly on a top layer to facilitate adhesion of a second layer of concrete mix.

Referring to FIG. 17; concrete mix 40 has concrete strengthening and adhesion material 38 mixed throughout to add omni-directional strength to concrete, and increased adhesion material at the top outer portion of the concrete layer.

Figure 18:
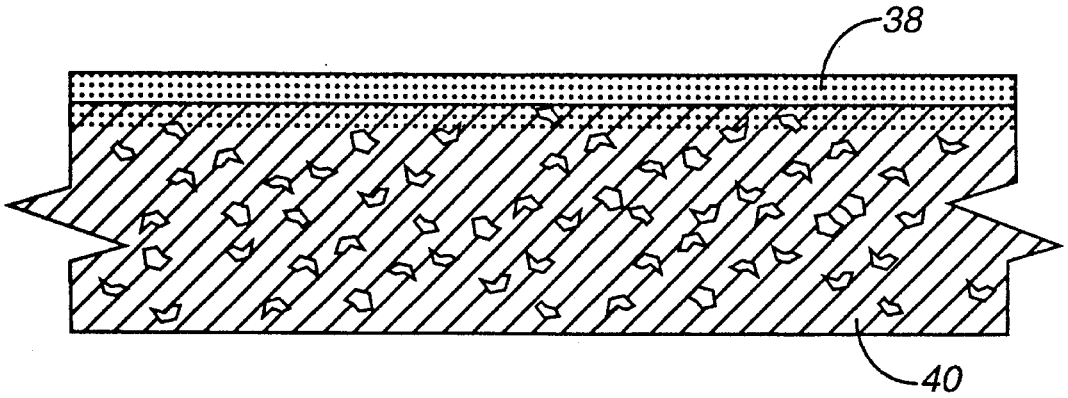
FIG. 18 is a cross sectional view of concrete mix with concrete strengthening and adhesion material distributed on a top superficial layer and extending outwardly on said top layer to facilitate adhesion of a second layer of concrete mix.

Referring to FIG. 18; concrete mix 40 has concrete strengthening and adhesion material 38 located on the top portion only to add omni-directional strength to concrete, and increased adhesion material at the top outer portion of the concrete layer.

It will be understood that each of the elements described above, or two or more together, may also find a useful application in other types of constructions differing from the type described above.

While the invention has been illustrated and described as embodied in a concrete strengthening and adhesion material feeding device, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An apparatus for delivering concrete strengthening and adhesion material into a concrete mix comprising:

a) a first housing having opposite ends and containing concrete strengthening and adhesion material processing means;

b) a Second housing containing mechanical means for driving said concrete strengthening and adhesion material processing means;

c) at least one ingress means integral with said first housing and positioned at one of said ends of said first housing, above a slotted plate, for receiving said concrete strengthening and adhesion material for processing;

d) at least one compression means, between said ingress means and said slotted plate, for compressing said concrete strengthening and adhesion material, said at least one compression means also functioning to enhance movement of said concrete strengthening and adhesion material in a direction of feed;

e) said concrete strengthening and adhesion material processing means comprising (i) a plurality of bars having opposite ends positioned underneath said at least one compression means and supporting a plurality of spikes extending toward said at lease one compression means and wherein said plurality of spikes function in a reciprocating fashion to separate and move said concrete strengthening and adhesion material in said direction of feed;

(ii) a first camshaft and a second camshaft, having axes transverse to said direction of feed, one of said ends of said bars being attached to said first camshaft and the opposite end of each of said bars being attached to said second camshaft, whereby said bars and said spikes move in said reciprocating fashion in response to movement of said first and second camshafts, thus separating and dragging said concrete strengthening and adhesion material in said direction of feed, maid spikes being capable of protruding through said slotted plate which functions to support said concrete and strengthening and adhesion material to be moved in said direction of feed;

(iii) at least one impeller means and at least one agitator means, each rotatably mounted around a separate axis, each of said axes being transverse to said direction of feed, wherein said at least one impeller means functions to receive said concrete strengthening and adhesion material from said at least one agitator means and evenly distribute said concrete strengthening and adhesion material into an egress means;

f) at least one adjustable metering non-rotating means located between said spikes and said at least one agitator means for regulating an amount of said concrete strengthening and adhesion material to be added to said concrete mix; and g) said egress means being integral with said first housing and positioned at the end opposite said one end of said first housing to deliver said concrete strengthening and adhesion material to said concrete mix.

* * * * *